US010907916B2

(12) United States Patent
Hopkins et al.

(10) Patent No.: US 10,907,916 B2
(45) **Date of Patent: *Feb. 2, 2021**

(54) SLIDE BLOCK MECHANISM FOR SEMI-AUTOMATIC PISTOLS

(71) Applicant: Hush Puppy Project LLC., Baton Rogue, LA (US)

(72) Inventors: Edward Cameron Nind Hopkins, Henderson, NV (US); Paul Liebenberg, Palm Bay, FL (US); Claudio Salassa, Houston, TX (US)

( * ) Notice: Subject to any disclaimer, the term of this patent is extended or adjusted under 35 U.S.C. 154(b) by 75 days.

This patent is subject to a terminal disclaimer.

(21) Appl. No.: 16/040,202

(22) Filed: Jul. 19, 2018

(65) Prior Publication Data

US 2019/0086169 A1 Mar. 21, 2019

Related U.S. Application Data

(60) Provisional application No. 62/534,431, filed on Jul. 19, 2017.

(51) Int. Cl.
*F41A 3/68* (2006.01)
*F41A 3/42* (2006.01)
*F41C 3/00* (2006.01)

(52) U.S. Cl.
CPC ..... *F41A 3/68* (2013.01); *F41A 3/42* (2013.01); *F41C 3/00* (2013.01)

(58) Field of Classification Search
CPC ..... F41A 3/68; F41A 3/42; F41C 3/00
USPC ..... 42/70.01
See application file for complete search history.

(56) References Cited

U.S. PATENT DOCUMENTS 1,176,254 A * 3/1916 Smith ..... F41A 3/12 89/138
2,115,041 A * 4/1938 Obregon ..... F41A 11/00 89/138
4,176,584 A * 12/1979 Thomas, Jr. ..... F41A 17/38 89/138
4,208,947 A * 6/1980 Hillberg ..... F41A 17/74 89/148
4,512,236 A * 4/1985 Thevis ..... F41A 19/33 89/128
4,549,465 A * 10/1985 Charron ..... F41A 17/36 89/138
4,555,973 A * 12/1985 Timari ..... F41A 11/04 89/1.4
4,627,184 A * 12/1986 Ruger ..... F41A 15/16 42/25

(Continued)

*Primary Examiner* — Michelle Clement
(74) *Attorney, Agent, or Firm* — Crump Law P.C.

(57) ABSTRACT

A slide block mechanism for a semi-automatic pistol that locks the slide in battery and prevents the slide from reciprocating when the pistol is discharged. The slide block mechanism consists of a pair of aligned notches formed in the bottom edge of the slide and the top of the frame, and a pivoting slide block lever mounted to the frame that selectively seats within either of the aligned notches. The slide block lever can be manually switched to engage and disengage the slide block mechanism and is independent of the fire control and slide stop assemblies. The slide block lever has a protrusion that seats within the slide notch when engaged to prevent the slide from moving rearward and seats within the frame notch when disengaged for allowing normal operation of the slide.

3 Claims, 9 Drawing Sheets

(56) References Cited

U.S. PATENT DOCUMENTS 4,742,634 A * 5/1988 Swenson ..... F41A 17/42 42/70.01
4,915,011 A * 4/1990 Smith ..... F41A 17/42 89/176
5,267,407 A * 12/1993 Bornancini ..... F41A 17/30 42/70.08
5,808,229 A * 9/1998 Bastian ..... F41A 11/02 89/128
6,415,702 B1 * 7/2002 Szabo ..... F41A 17/28 42/70.08
6,494,194 B2 * 12/2002 Shipachev ..... F41A 9/76 124/31
6,560,909 B2 * 5/2003 Cominolli ..... F41A 17/46 42/70.05
7,047,686 B2 * 5/2006 Zimmermann ..... F41A 5/04 42/106
8,006,609 B2 * 8/2011 Kallio ..... F41A 17/42 42/14
8,065,950 B2 * 11/2011 Kaminsky ..... F41A 5/20 89/196
8,881,443 B2 * 11/2014 Westwood ..... F41A 17/02 42/70.05
8,950,100 B2 * 2/2015 Nebeker ..... F41A 3/64 42/108
9,057,571 B2 * 6/2015 Kemmerer ..... F41A 17/20
9,057,574 B2 * 6/2015 McClave ..... F41A 17/42
9,207,032 B2 * 12/2015 Curry ..... F41A 17/36
9,448,023 B2 * 9/2016 Sheets, Jr. ..... F41A 17/46
9,933,222 B2 * 4/2018 Hirschheiter ..... F41A 17/36
10,234,225 B2 * 3/2019 Zukowski ..... F41A 17/20
10,378,838 B2 * 8/2019 Hopkins ..... F41A 3/42
2009/0071053 A1 * 3/2009 Thomele ..... F41A 11/02 42/1.01
2010/0170132 A1 * 7/2010 Zukowski ..... F41A 17/66 42/70.08
2010/0170138 A1 * 7/2010 Zukowski ..... F41A 17/66 42/148
2010/0281735 A1 * 11/2010 Kallio ..... F41A 15/16 42/25
2011/0219656 A1 * 9/2011 McGarry ..... F41A 11/00 42/70.06
2018/0347933 A1 * 12/2018 Molina ..... F41A 35/04
2019/0195587 A1 * 6/2019 Thomele ..... F41A 17/60
2019/0195596 A1 * 6/2019 Thomele ..... F41C 23/10
2019/0285373 A1 * 9/2019 Palkow ..... F41A 19/16

* cited by examiner

SLIDE BLOCK MECHANISM FOR SEMI-AUTOMATIC PISTOLS

This application claims the benefit of U.S. Provisional Application No. 62/534,431 filed Jul. 19, 2017.

This invention relates to semi-automatic pistols, and in particular a slide block mechanism for blocking the slide in battery and preventing the reciprocation of the slide when the pistol is discharged.

BACKGROUND OF THE INVENTION

The discharge of semi-automatic pistols creates extremely high levels of noise. The report of a pistol can cause serious hearing damage to the user and surrounding persons. The sound created by the discharge of a pistol is the result of the escaping propellent gas the hyper sonic travel of the projectile, and the mechanical action, i.e. the reciprocation of the slide of the semi-automatic pistols. Sound suppressors, often inaccurately referred to as "silencers" generally baffle and dampen the sounds of the escaping propellent gas. The use of sub-sonic ammunition helps lessen the sound of projectile travel. The noise created by the mechanical action of the pistol cannot be mitigated unless the slide is physically prevented from reciprocating upon discharge. Heretofore, semi-automatic pistols generally include slide stop mechanisms that lock the slide to the rear when the magazine is empty, but have no mechanism for physically locking the slide in battery, i.e. the forward closed position, and preventing the slide from reciprocating on discharge.

SUMMARY OF THE INVENTION

This invention provides a slide lock mechanism that blocks the slide in battery and prevents the slide from reciprocating when the pistol is discharged. The slide block mechanism consists of a pair of aligned notches formed in the bottom edge of the slide and the top of the frame, and a slide block lever mounted to the pistol frame that is selectively pivoted to seat within either of the aligned notches. The slide block lever has a protrusion that seats within the slide notch when engaged to prevent the slide from moving rearward and seats within the frame notch when disengaged for allowing normal operation of the slide. The slide block lever is manually manipulated or switched to engage and disengage the slide block function. In certain embodiments, the slide block mechanism of this invention operatively utilizes certain available components of the pistol's fire control mechanism. In all embodiments, the slide block mechanism functions independently of the pistol's slide stop assemblies and does not affect any function or operation of the pistol's fire control mechanism.

The slide block mechanism effectively allows the user to selectively switch a semi-automatic pistol to a single shot pistol. When engaged, the slide block mechanism prevents the reciprocation of the slide, eliminating the sound of the action. When disengaged, the slide block mechanism does not affect the operation of the pistol allowing the slide to reciprocate freely. The slide block mechanism also does not alter or effect the operation of the fire control mechanism of the pistol and is completely independent of the pistol's traditional slide stop and fire control assemblies. The slide block mechanism may be integrated into many conventional semi-automatic pistol designs, with minor modifications to the slide and frame, and may co-opt or use the internal pins and components of the pistol's fire control mechanism to support the pivoting slide lever.

These and other advantages of the present invention will become apparent from the following description of an embodiment of the invention with reference to the accompanying drawings.

BRIEF DESCRIPTION OF THE DRAWINGS

The drawings illustrate an embodiment of the present invention, in which.

DESCRIPTION OF THE PREFERRED EMBODIMENT

Figure 1:
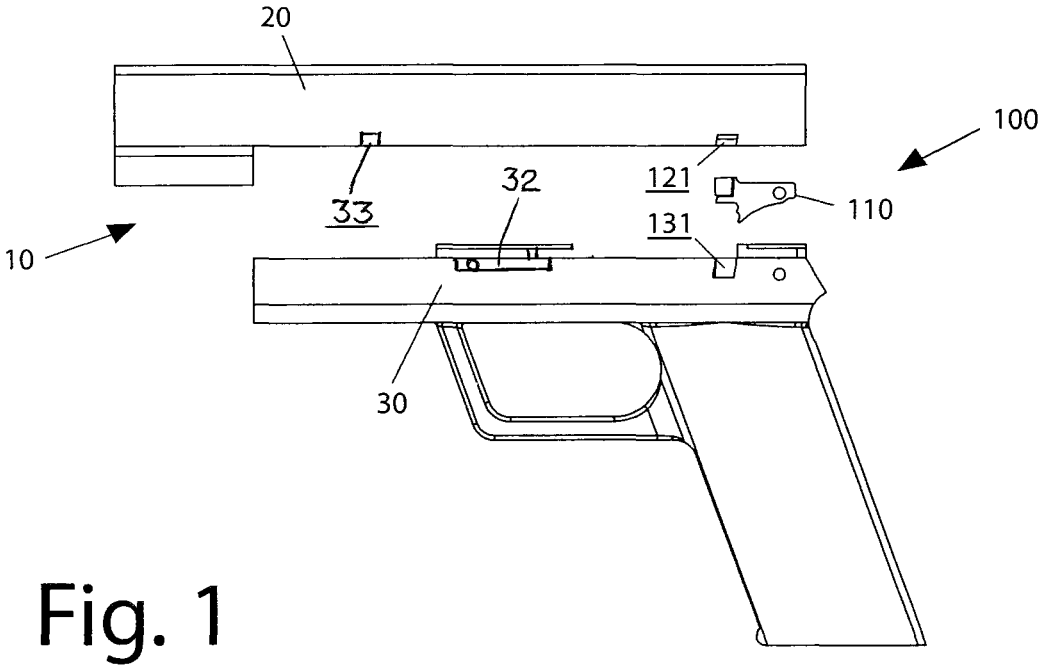
FIG. 1 is an exploded view of a generic semi-automatic pistol using an exemplary embodiment of the slide lock mechanism of this invention.
Figure 2:
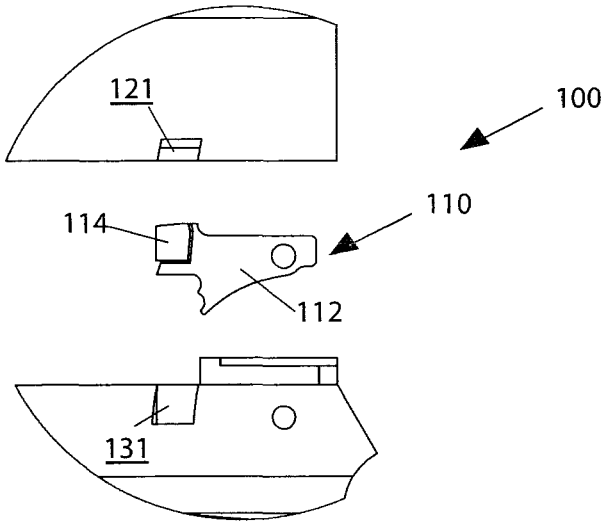
FIG. 2 is a partial magnified view of the slide lock mechanism of FIG. 1.

In the following detailed description of the preferred embodiments, reference is made to the accompanying drawings that form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical, structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense, and the scope of the present invention is defined only by the appended claims.

The slide lock mechanism of this invention helps minimize the sound signature of semi-automatic pistols by eliminating the noise caused by the reciprocation of the slide during the firing cycle. The slide block mechanism of this invention is designed and intended for use with any semi-automatic pistol and may be modified or adapted to function within the teachings of this invention with any semi-automatic pistol, regardless of the particular design, style, type or make of pistol. Semi-automatic pistols, their construction, operation and function are generally well known and understood in the art. The illustrations and description of the pistol are presented to provide a general foundation and understanding of the slide block mechanism of this present invention and how it interacts with the basic components and functionality of a semi-automatic pistol.

FIGS. 1-6 show an exemplary embodiment of the slide block mechanism of this invention, which is designated generally as reference number 100, incorporated into a generic semi-automatic pistol 10. Generic pistol 10 includes a reciprocating slide 20 and a frame 30. Slide 20 houses the barrel (not shown) and portions of the fire control mechanism, such as the firing pin or strike, firing pin block (also not shown). Frame 30 houses or supports portions of the fire control mechanism, such as the trigger, trigger bar, sear, striker or hammer (not shown). Frame 30 also includes a slide stop lever 32 that actuates to lock slide 20 to the rear of its travel after the discharge of the last round in the magazine (not shown) or when manually engaged by the shooter. The slide stop lever 32 seats within a slide stop notch 33 formed in slide 20 to hold slide 20 at its rearward position. Disengaging slide stop lever 32 from notch 33 allows slide 20 to snap forward back into battery.

Slide block mechanism 100 is separate from and operates independent of the fire control and slide stop lever 32 and only interacts with slide 20 and frame 30. When engaged, slide block mechanism 100 locks the slide in battery and prevents the slide from moving rearward when pistol 10 is discharged. When disengaged, slide block mechanism 100 allows normal pistol functionality.

Figure 3:
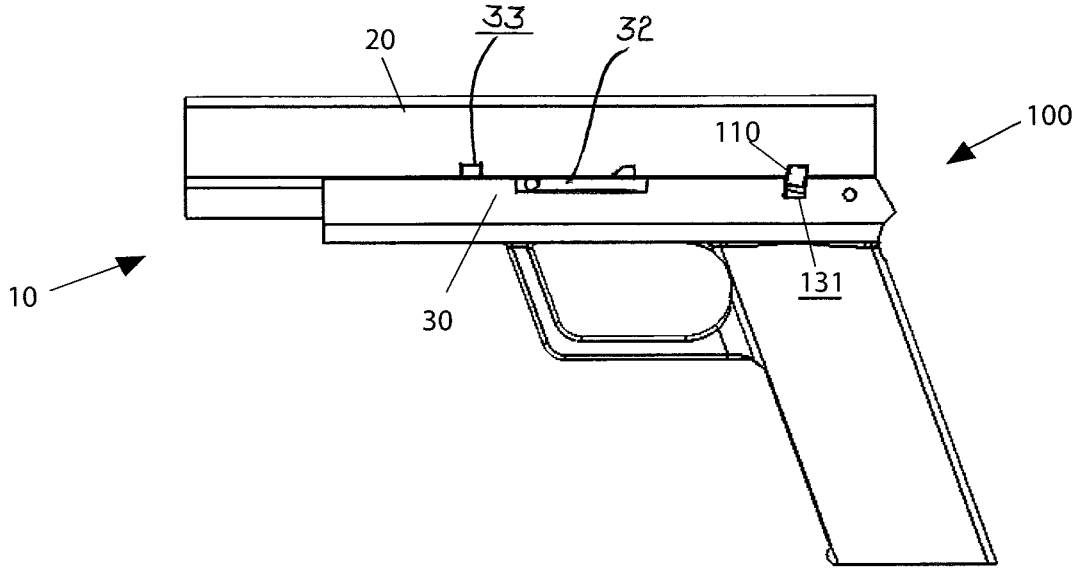
FIG. 3 is a side view of the pistol of FIG. 1 showing the slide lock mechanism in the engaged position.
Figure 4:
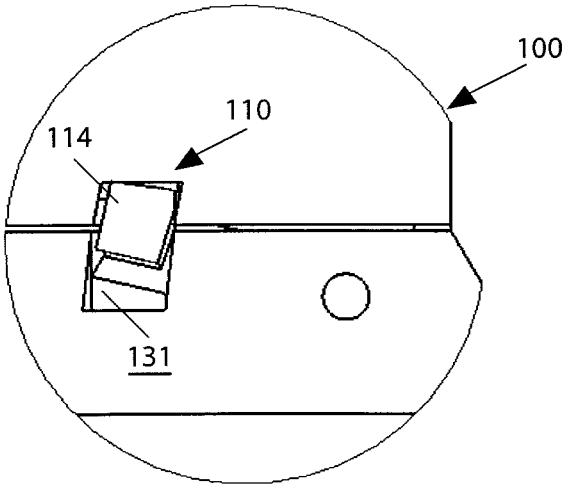
FIG. 4 is a partial magnified view of the slide lock mechanism of FIG. 3.
Figure 5:
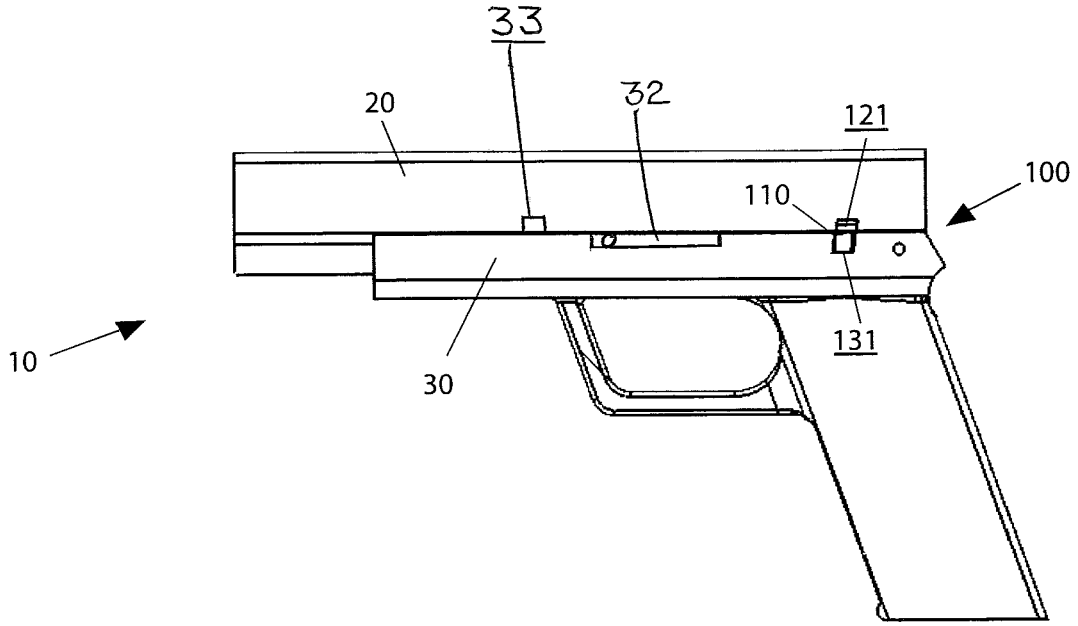
FIG. 5 is a side view of the pistol of FIG. 1 showing the slide lock mechanism in the disengaged position.
Figure 6:
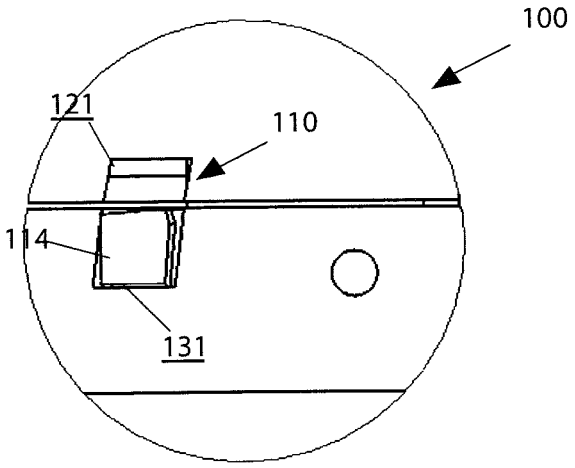
FIG. 6 is a partial magnified view of the slide lock mechanism of FIG. 5.
Figure 7:
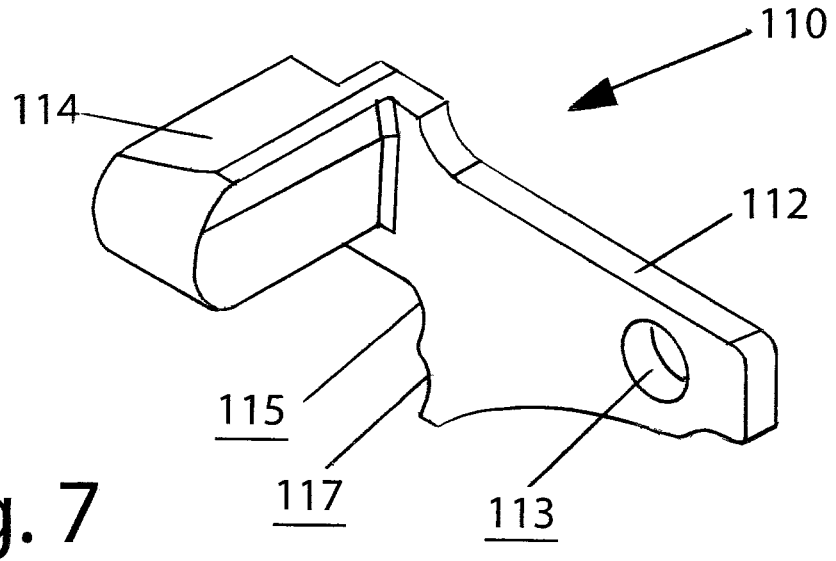
FIG. 7 is a perspective view of an exemplary embodiment of the slide lock lever of this invention.
Figure 8:
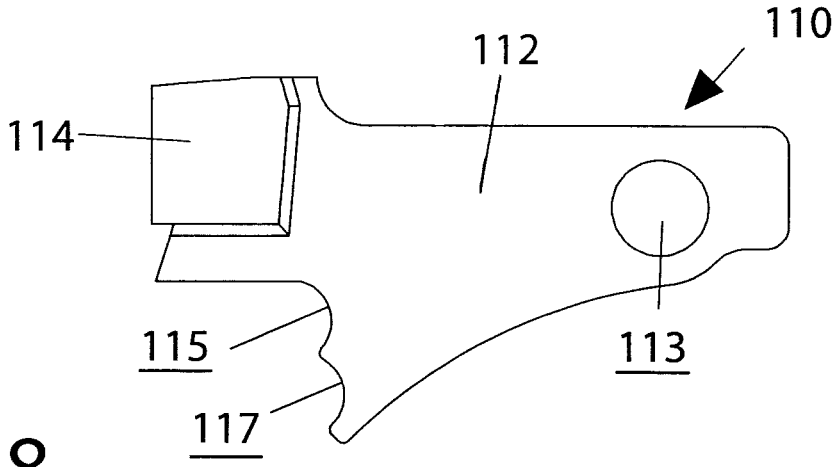
FIG. 8 is a left side view of the slide lock lever of FIG. 4.
Figure 9:
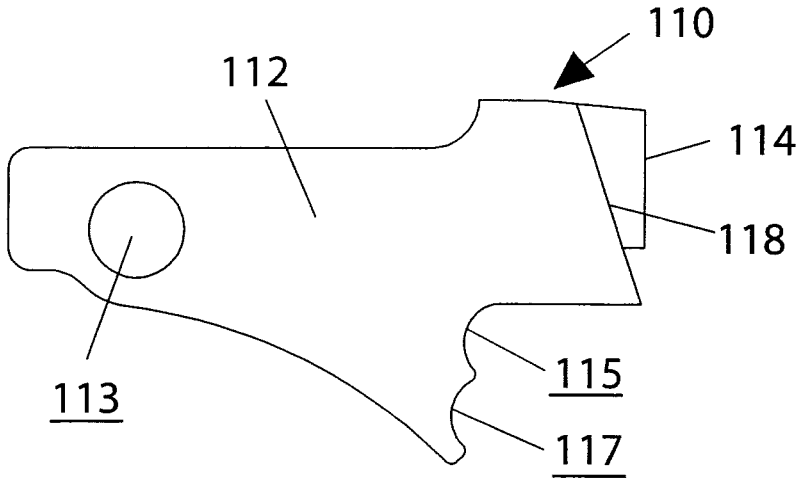
FIG. 9 is a right side view of the slide lock lever of FIG. 4.
Figure 10:
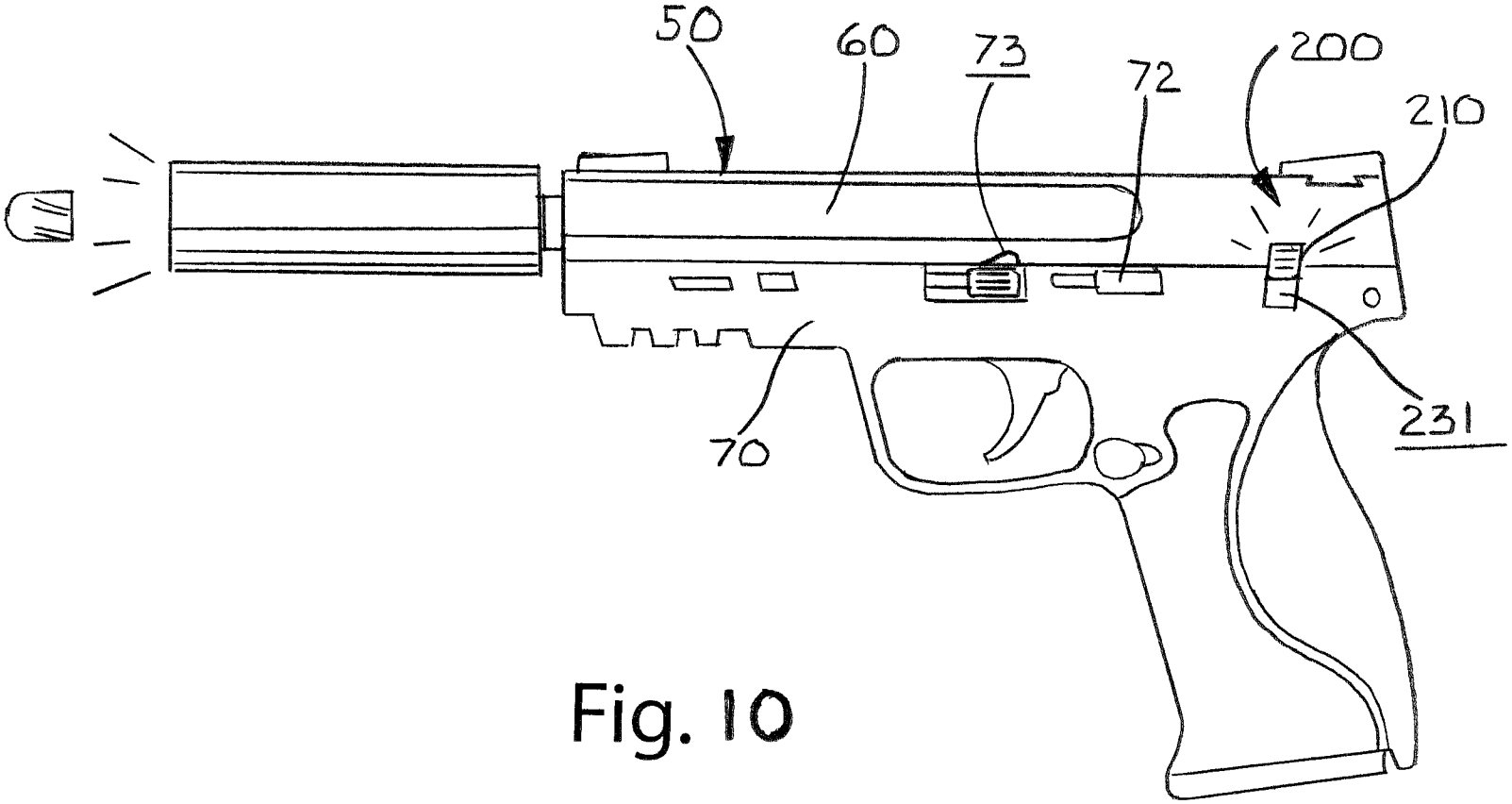
FIG. 10 is a side view of another pistol using a second exemplary embodiment of the slide block mechanism of this invention shown in the engaged position.
Figure 11:
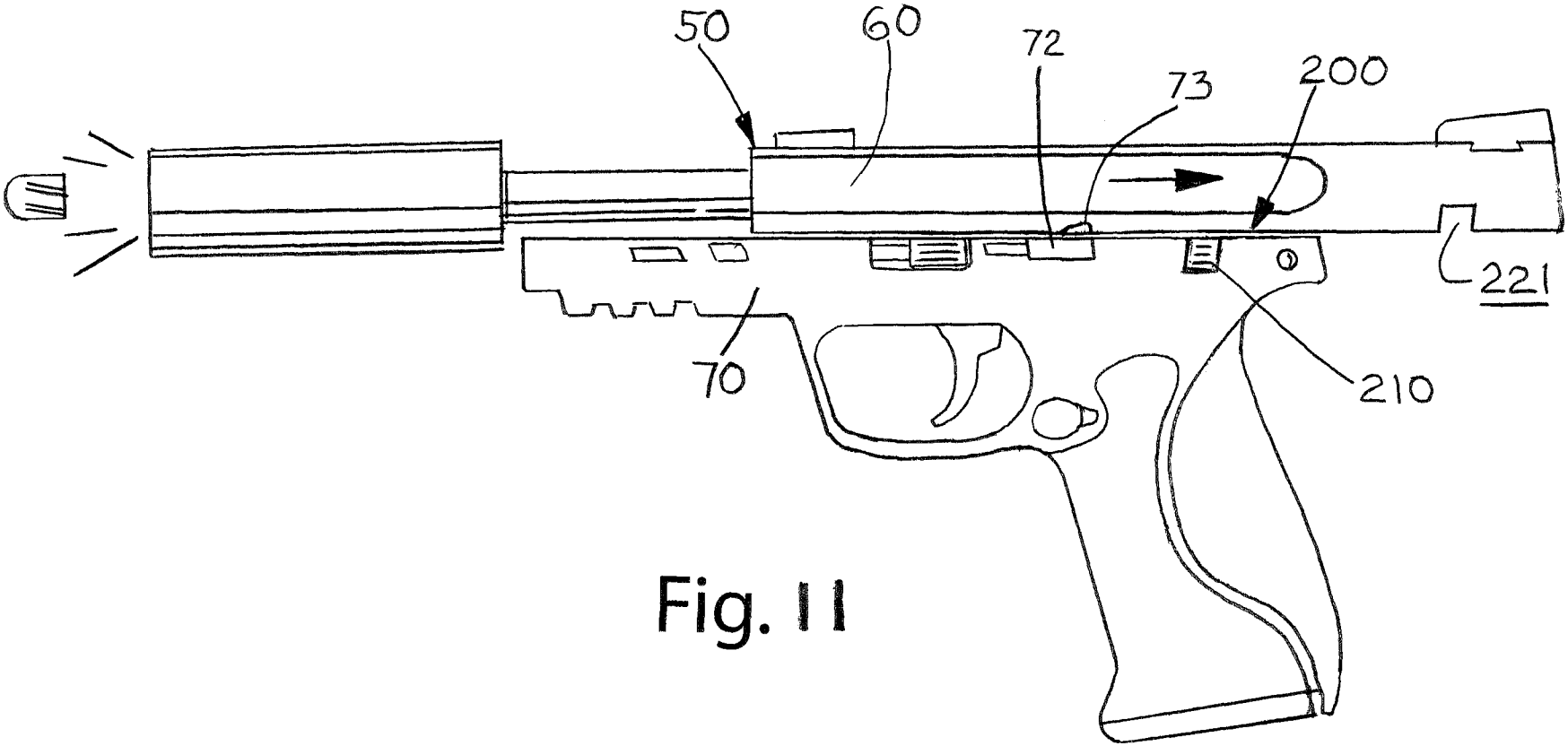
FIG. 11 is a side view of the pistol and slide block mechanism of FIG. 10 shown in the disengaged position.
Figure 12:
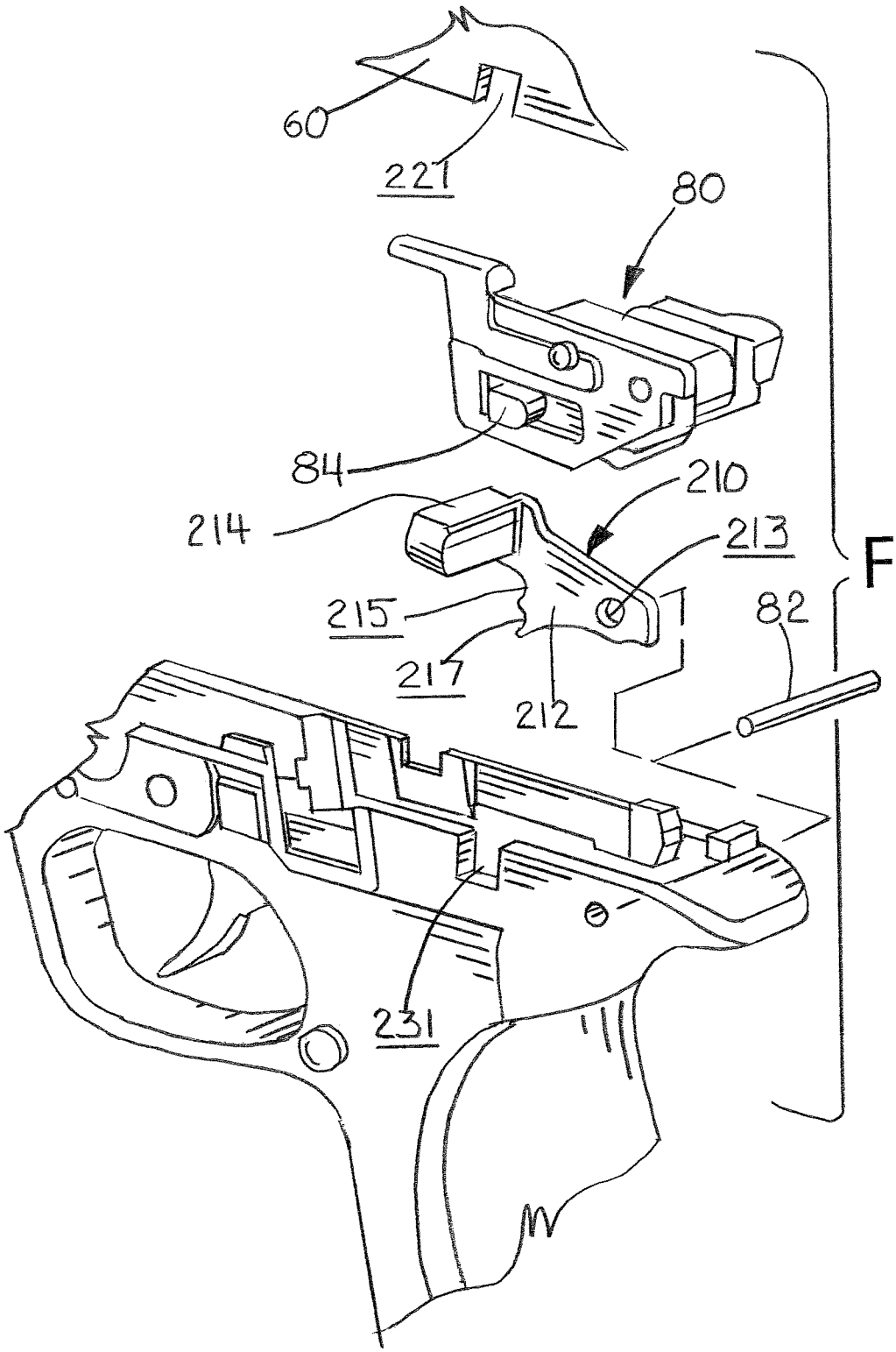
FIG. 12 is a partial exploded view of the pistol and slide block mechanism of FIG. 10.

As shown in FIGS. 1-9, slide block mechanism 100 includes a block lever 110, which is pivotally connected to frame 30 for movement between an engaged position (FIG. 2) and a disengaged position (FIG. 3). Block lever 110 is located on frame 30 spaced from slick stop lever 32. Block lever 110 is a metal component, conventionally machined, metal injection molded (MIM) or electrical discharge machining (EDM) machined, investment cast or otherwise constructed from a steel, aluminum or other suitable metal or alloy. Block lever 110 has a flat lever body 112 and an integral protrusion 114 extending from the lever body. Lever body 112 has two recessed intends 115 and 117 formed along its intermediate contact edge 116 (FIG. 4). Lever body 112 also has an angled forward contact face 118 (FIG. 6). Block lever 110 is pivotally connected to frame 30 in a cantilevered orientation by a pin (not shown) that extends through a bore 113 in lever body 112. Block lever 110 can be internally (as shown) or externally mounted to frame 30. In addition, block lever 110 can be positioned anywhere along the length of the frame, but is ideally located toward the rear of the pistol.

Slide block mechanism 100 also uses a pair of aligned notches 121 and 131 formed in slide 20 and frame 30. As shown, notch 121 is machined or cut into the bottom left edge of slide 20 and dimensioned to receive protrusion 114 when block lever 110 is in the engaged position and the slide is in battery. Notch 131 is machined into the left top edge of frame 30 generally aligned with notch 121 and dimensioned to receive protrusion 114 when block lever 110 is in the disengaged position and the slide is in battery.

Slide block mechanism 100 is engaged by manually pressing block lever 110 upward into the engaged position (FIG. 2) so that the protrusion 114 seats within slide notch 121 blocking any rearward movement of the slide. In the engaged position, block lever 110 is held in place by tension with no manual pressure needed on the lever. Slide block mechanism 100 is disengaged by manually pressing block lever 110 downward into the disengaged position (FIG. 3) so that the protrusion 114 seats within frame notch 131. In the disengaged position, protrusion 114 is spaced from slide notch 121 and slide 20 can freely reciprocate to allow normal operation and function of pistol 10.

FIGS. 10-15 show another exemplary embodiment of the slide block mechanism of this invention, which is designated generally as reference number 200. In this embodiment, slide block mechanism 200 is incorporated into a particular pistol model, the Smith and Wesson M&P M2.0 with the Manual Thumb safety manufactured by American Outdoor Brands Corporation of Springfield, Mass., which is designated generally as reference numeral 50. Pistol 50 includes a reciprocating slide 60 and pistol frame 70. Pistol 50 also includes a slide stop lever 72 pivotally connected to frame 70 and a slide stop notch 73 formed in slide 60. As with generic pistol 10 described above, slide stop lever 72 seats within notch 73 to lock slide 60 in its rearmost position.

Figure 14:
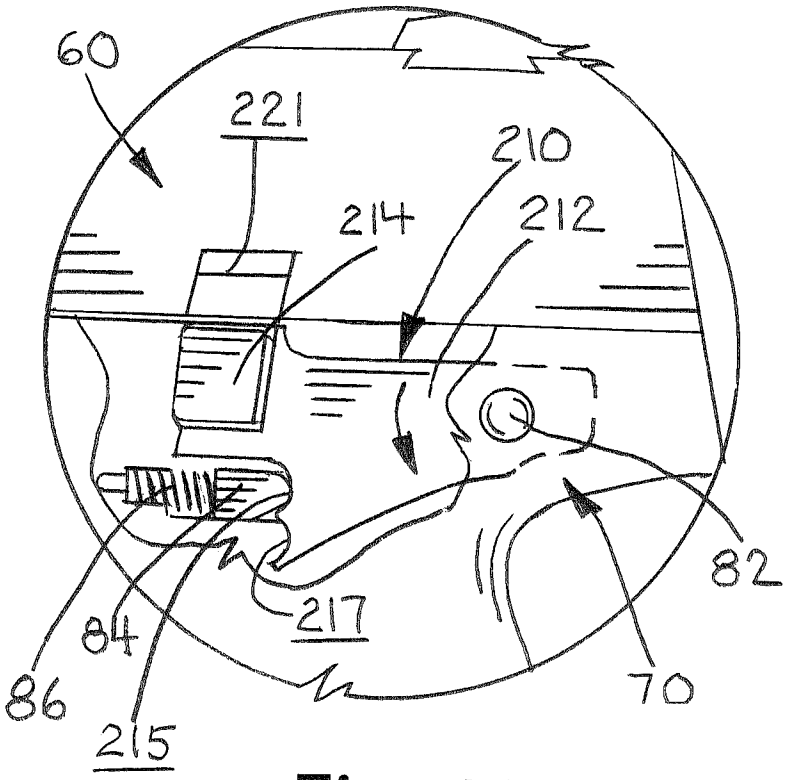
FIG. 14 is a partial side view with portions cut away of the pistol and slide block mechanism of FIG. 10 shown in the disengaged position.
Figure 13:
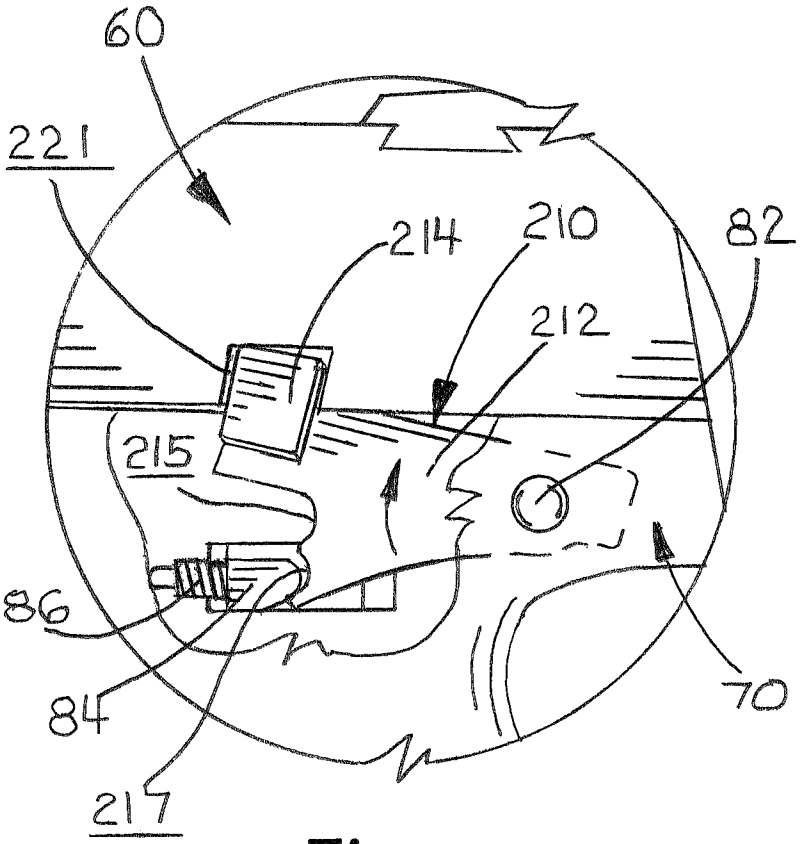
FIG. 13 is a partial side view with portions cut away of the pistol and slide block mechanism of FIG. 10 shown in the engaged position.
Figure 15:
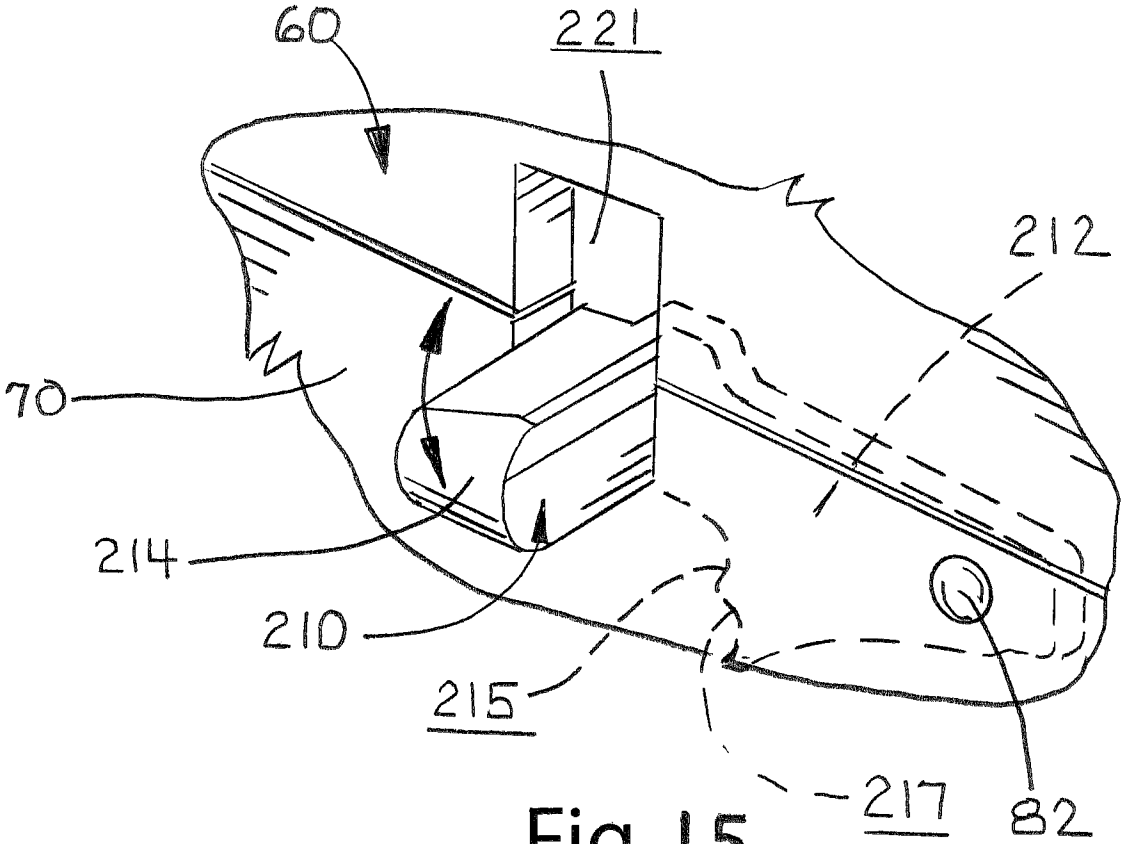
FIG. 15 is a partial perspective of the pistol and slide block mechanism of FIG. 10 shown in the disengaged position.

As with the previous embodiment, slide block mechanism 200 uses a pair of aligned notches 221 and 231 formed in slide 60 and frame 70 and includes a block lever 210 pivotally connected to frame 70. Again, block lever 210 is operatively independent and spaced from slide stop lever 72 of pistol 50. This particular model of pistol 50 has a fire control mechanism that initially includes a manual safety selector (not shown) that is removed to accommodate block lever 210. This manual safety selector is integrated into the sear housing assembly 80 that is nested within frame 70. Sear housing assembly 80 is held within frame 70 by pin 82, which normally serves as the pivot pin for the manual safety. In this embodiment, block lever 210 replaces the manual safety selector and is held within frame 70 by pin 82. Block lever 210 occupies the space within frame 70 along one side of sear housing assembly 80 where the safety selector normally was located. As with the safety selector, block lever 210 pivots about pin 82 between the engaged position (FIG. 13) and disengaged position (FIG. 14). Sear housing assembly 80 also includes a sprung detent 84 that normally engages the manual safety, but is coopted to engage block lever 210. Detent 82 extends from sear housing assembly 80 and is biased by coil spring 86 to seat within one of two scallops 215 and 217 to hold block lever 210 in either the engaged or disengaged positions.

One skilled in the art will note that the slide block mechanism of this invention effectively allows the user to selectively switch a semi-automatic pistol to a single shot pistol. While traditional slide stop mechanisms lock the slide to the rear, the slide block mechanism prevents the slide from reciprocating rearward on discharge, thereby eliminating the sound of the action. The slide block mechanism does not otherwise affect the function or operation of the pistol and does not alter or affect the normal operation of the fire control or slide stop assemblies of the pistol. The slide block mechanism may also be integrated into many conventional semi-automatic pistol designs, with minor modifications to the slide and frame, and may co-opt or use the internal pins and other existing components of the pistol's fire control mechanism to support the pivoting slide block lever.

The various embodiments of the present invention herein described and illustrated are not intended to be exhaustive or to limit the invention to the precise form disclosed, but are presented to explain the invention so that others skilled in the art might utilize its teachings. The various embodiments of the present invention may be modified within the scope of the following claims.

We claim:

1. A slide block mechanism intended for use in a pistol that includes a frame, a reciprocating slide mounted to the frame, a slide stop part mounted to the frame, and a fire control mechanism seated within the frame, the slide block mechanism comprising:

a block lever pivotally but inoperatively mounted to the fire control mechanism within the frame and spaced independently from the slide stop part for movement between a first position and a second position;

a spring detent carried by the fire control mechanism within the frame and restrictively engaging the block lever to hold the block lever in either the first position or the second position;

a slide notch formed in the slide for receiving the block lever when the block lever is in the first position to lock the slide in battery and prevent the slide from moving rearward when the pistol is discharged; and a frame notch formed in the frame for receiving the block lever when the block lever is in the second position the block lever includes a lever body and a protrusion extending from the lever body, the lever body has a pair of scallops formed therein, the spring detent restrictively seats within one of the pair of scallops when the block lever is in the first position and within the other of the pair of scallops when the block lever is in the second position.

2. The slide block mechanism of claim 1 and a pin pivotally connecting the lever body to the fire control mechanism and the frame.

3. The slide block mechanism of claim 1 wherein the protrusion restrictively seats within the slide notch when the lever part is in the first position and the protrusion restrictively seats within the frame notch spaced from the slide notch when the lever part is in the second position.

* * * * *